US005556233A

United States Patent [19]

Kovago

[11] Patent Number: 5,556,233

[45] Date of Patent: Sep. 17, 1996

[54] ROCK ANCHOR ASSEMBLY

[75] Inventor: Vilmos Kovago, Edenvale, South Africa

[73] Assignee: RSC Mining (Proprietary) Limited, South Africa

[21] Appl. No.: 361,956

[22] Filed: Dec. 22, 1994

[30] Foreign Application Priority Data

Dec. 23, 1993 [ZA] South Africa ..... 93/9668
Jun. 3, 1994 [ZA] South Africa ..... 94/3910

[51] Int. Cl.[6] ..... E02D 17/00; E21D 20/00; E21D 21/0002; F16B 31/02

[52] U.S. Cl. ..... 405/259.4; 405/259.1; 405/302.2; 411/1; 411/8; 411/9

[58] Field of Search ..... 405/259.4, 259.1, 405/302.2; 411/9, 8, 1; 116/DIG. 34

[56] References Cited

U.S. PATENT DOCUMENTS

| | | | |
|---|---|---|---|
| 2,783,673 | 3/1957 | Lewis et al. | 411/53 |
| 2,970,444 | 2/1961 | Peter | 405/259.3 |
| 3,104,582 | 9/1963 | White | 411/60 |
| 3,349,662 | 10/1967 | Williams | 411/46 |
| 3,404,504 | 10/1968 | Taylor | 52/711 |
| 3,693,359 | 9/1972 | Karara | 405/259.3 |
| 4,160,615 | 7/1979 | Baldwin | 405/259 |
| 4,369,003 | 1/1983 | Brandstetter | 405/260 |
| 5,011,337 | 4/1991 | Clark et al. | 405/259.1 X |
| 5,113,634 | 5/1992 | Lüthi | 405/259.4 X |
| 5,230,589 | 7/1993 | Gillespie | 405/259.1 |
| 5,253,960 | 10/1993 | Scott | 405/302.2 |
| 5,259,703 | 11/1993 | Gillespie | 405/259.1 |
| 5,375,946 | 12/1994 | Locotos | 405/259.4 |

FOREIGN PATENT DOCUMENTS

| | | | |
|---|---|---|---|
| 52557/79 | 11/1978 | Australia . | |
| 9315279 | 8/1993 | Australia | 405/259.1 |
| 1289340 | of 1962 | France . | |
| 1461377 | of 1965 | France . | |
| 6116952 | 4/1994 | Japan | 405/259.1 |
| 912987 | 12/1962 | United Kingdom . | |
| 93/15279 | 8/1993 | WIPO . | |

*Primary Examiner*—David J. Bagnell
*Assistant Examiner*—Tara L. Mayo
*Attorney, Agent, or Firm*—Brinks, Hofer, Gilson & Lione

[57] ABSTRACT

A rock anchor includes an elongate element. A transverse dimension of a portion of the elongate element is enlarged. The transverse dimension is reducible on the application of a suitable force applied to the enlarged portion. The invention extends to a tensioning device for use with the rock anchor and to a yielding anchor assembly which includes the rock anchor and the tensioning device.

10 Claims, 6 Drawing Sheets

ROCK ANCHOR ASSEMBLY

FIELD OF THE INVENTION

This invention relates to rock anchors. More particularly, this invention relates to a rock anchor, a tensioning device for use with a rock anchor and a yielding anchor assembly.

SUMMARY OF THE INVENTION

According to a first aspect of the invention, there is provided a rock anchor which includes an elongate element; and an enlarging means carried on at least a portion of the elongate element for enlarging a transverse dimension of said portion of the elongate element, said transverse dimension being reducible on the application of a suitable force applied to the enlarging means.

In use, a tensioning device is arranged proximate one end of the elongate element to grip the elongate element and to maintain a suitable tension within the elongate element. The tensioning device defines a passage through which the elongate element passes and via which said suitable force is applied to the enlarging means.

The elongate element may be in the form of a multi-strand cable. The enlarging means may be in the form of a sleeve receivable over a part of one strand of the cable to be surrounded by other strands of the cable radially to enlarge the cable along said portion. The sleeve may be of a suitably malleable metal.

The rock anchor may include a stop arranged at one end of the elongate element, the stop having a transverse dimension which is greater than that of the enlarging means, and thus incapable of passing through the passage. Hence, once the enlarging means has passed through the passage, and the stop abuts against the gripping means, further tension imparted to the elongate element will cause the elongate element to snap. The stop may be swaged onto a free end of the wire rope.

According to a second aspect of the invention, there is provided a tensioning device for use with a rock anchor, the device including a gripping means for gripping an elongate element of the rock anchor, the gripping means defining a passage through which the elongate element can pass;

a clamping means for urging the gripping means into gripping relationship with the elongate element; and a tensioning member carried on the clamping means for effecting tensioning of the elongate element.

It is to be understood that a rock anchor is often anchored in a borehole by, for example, utilising grout or a mechanical shell which is arranged on one end of the anchor and a nut which is engageable with a threaded portion defined at the other end of the anchor. The nut, in this case, will abut against a suitable bearing surface such as that defined by a dome washer. It will be readily appreciated that this invention dispenses with the need for the threaded portion. Further, practically any form of rock anchor may be tensioned with the device. In particular, for the purposes of cost effectiveness and ease of handling, the rock anchor may be flexible and may, in particular, be in the form of a length of multi-strand cable.

The device may include an adjustment means for adjusting a transverse dimension of said passage.

The gripping means may comprise a jaw assembly having a plurality of discrete jaws which define a passage through which the elongate element passes, in use. The jaws may each have a tapered outer surface so that the jaw assembly is substantially frusto-conical. The jaws may be held together via a suitable holding means, such as a circlip-type spring arrangement.

The clamping means may comprise a first element which defines a tapered seat which is complementary to the tapered outer surfaces of the jaws and a second element which is arranged on the first element to retain the jaw assembly in position once the jaw assembly has been urged into abutment with the seat so that the jaws are urged into gripping engagement with the elongate element, in use.

The second element may be adjustably arranged within the first element to urge the jaw assembly into abutment with the seat, in use.

The displacing means may include a third element adjustably arranged relative to the first element of the clamping means.

The adjustment means may include a bearing surface defined within the third element. The bearing surface may be positioned such that, on displacement of the third element towards the first element, the bearing surface bears against the jaw assembly and displaces the jaw assembly towards a larger end of the tapered seat. The bearing surface may be defined by a thrust member within the third element.

Each jaw may have a smooth inner surface defined thereon. This results in the jaws, when gripping the elongate element, being able to slip fractionally with respect to the elongate element when a load is exerted on the rock anchor. Hence, instead of the elongate element failing when a sudden force is exerted on the elongate element, the device will slip relative to the elongate element when a sufficient load is exerted on the elongate element.

Instead, each jaw may have an inner surface which is roughened to facilitate non-slip gripping of the roof bolt.

The second element may be calibrated so that a user can adjust the gripping force of the jaws.

According to a third aspect of the invention, there is provided a yielding anchor assembly which includes a rock anchor according to the first aspect of the invention, as described above; and a tensioning device for tensioning the elongate element, the tensioning device defining a passage through which the elongate element slips when said suitable tension is exceeded, the passage being dimensioned so that when the tension is exceeded, the suitable force is applied to the enlarging means to reduce the transverse dimension and to permit the portion to be drawn through the passage.

The tensioning device may be the tensioning device according to the second aspect of the invention.

The invention is now described, by way of examples, with reference to the accompanying drawings.

DETAILED DESCRIPTION OF THE DRAWINGS

Figure 1:
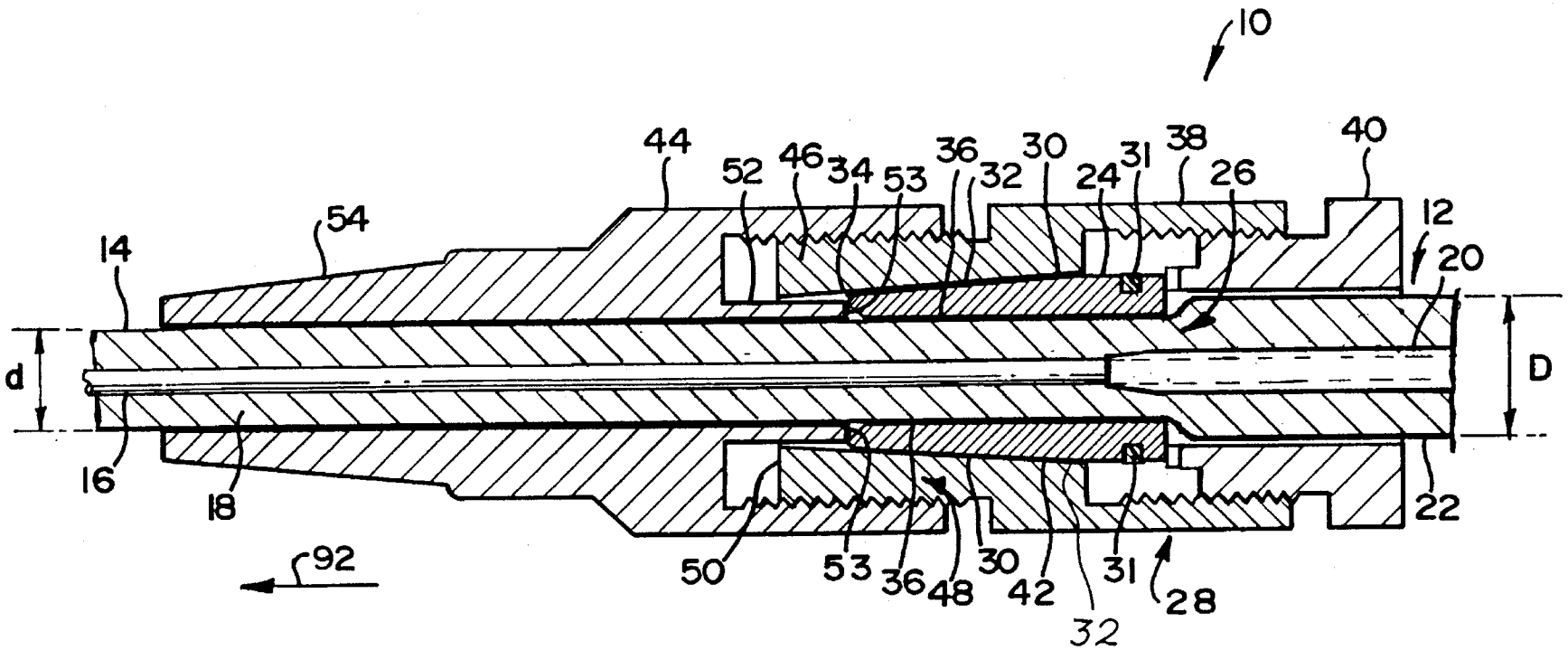
FIG. 1 shows a sectional side view of part of a yielding anchor assembly in accordance with a first embodiment of a third aspect of the invention.

In FIG. 1, reference numeral 10 generally indicates part of a yielding anchor assembly in accordance with a first embodiment of a third aspect of the invention.

The yielding anchor assembly 10 includes a rock anchor 12. The rock anchor 12 includes a wire rope in the form of a multi-strand cable 14 having a central strand 16 surrounded by a plurality of helically wound outer strands 18. The strands 16, 18 are cold-drawn and have a polygonal cross-section.

The rock anchor 12 further includes an enlarging means in the form of a sleeve 20 received over a portion of said central strand 16 to be surrounded by the outer strands 18 along a portion 22 of the cable 14. The sleeve 20 is of a malleable material, such as copper or steel tubing. The part of the cable 14 without the sleeve 20 has a diameter d while the part of the cable having the sleeve 20 has a diameter D, it being understood that the diameter D is greater than the diameter d.

Since the sleeve 20 is of a malleable material, it is radially deformable on the application of a force applied thereto for radially reducing said diameter D of the cable 14 to the diameter d.

The yielding anchor assembly 10 further includes a gripping means in the form of a jaw assembly 24 for gripping the cable 14 and maintaining a suitable tension in the cable 14. The jaw assembly 24 is arranged, in use, inwardly of the portion 22. The assembly 24 defines a passage 26 through which the cable 14 slips when said suitable tension is exceeded, the passage 26 being dimensioned so that when said tension is exceeded, the portion 22 is radially deformed to be drawn through the passage 26 in the direction of an arrow 92.

The assembly 10 includes a clamping means 28 for urging the jaw assembly 24 into gripping relationship with the cable 14. The jaw assembly 24 comprises three jaws 30 which define the passage 26. The jaws 30 have a tapered outer surface 32. In particular, the jaw assembly 24 is frusto-conical with its smaller end 34 furthest from the portion 22, in use. An inner surface 36 of each jaw 30 is smooth. The jaws 30 are held together by a circular clip 31.

The clamping means 28 comprises a first element or nut 38 and a second element or nut 40. The first nut 38 defines a tapered seat 42 for the jaw assembly 24. The second nut 40 is threadedly received within the first nut 38 to urge the jaw assembly 24 into abutment with said seat 42. Hence, in use, the jaws 30 of the jaw assembly 24 are urged into gripping engagement with the cable 14 on tightening of the second nut 40 relative to the first nut 38.

The assembly 10 includes a third element or nut 44 which interacts with the first nut 38. Thus, the first nut 38 has a threaded projection 46 defined thereon and the third nut 44 has a threaded socket 48 defined therein in which the projection 46 is threadedly received. Hence, the third nut 44 can be displaced axially with respect to the first nut 38.

It is to be appreciated that the value of the tension in the cable 14 resulting in the drawing of the portion 22 through the passage 26 is, to an extent, dependent upon the diameter of the passage 26 relative to the diameter D of the enlarged portion 22 of the cable 14. More particularly, if the diameter of the passage 26 relative to the diameter D of the portion 22 is increased, the value of the tension in the cable 14 will decrease.

It is further to be appreciated that, if the jaw assembly 24 is shifted relative to the first nut 38 away from a smaller end 50 of the tapered seat 42, the enlarged portion 22 of the cable 14 will be more easily accommodated in the passage 26. This will result in a lowering of the tension required in the cable 14 to cause movement of the enlarged portion 22 relative to the jaw assembly 24 in the direction of the arrow 92. Hence, the assembly 10 includes an adjustment means in the form of a thrust member 52 which defines a bearing surface 53 arranged within the third nut 44. The member 52 is positioned such that on displacement of the third nut 44 towards the first nut 38, the surface 53 bears against the jaw assembly 24 and displaces the jaw assembly 24 away from the smaller end 50 of the tapered seat 42. Hence, by adjusting the position of the third nut 44 relative to the first nut 38, the tension can, to an extent, be altered. The thrust member 52 is tubular and the bearing surface 53 is of similar dimensions to the smaller end 34 of the wedge 24.

Figure 3:
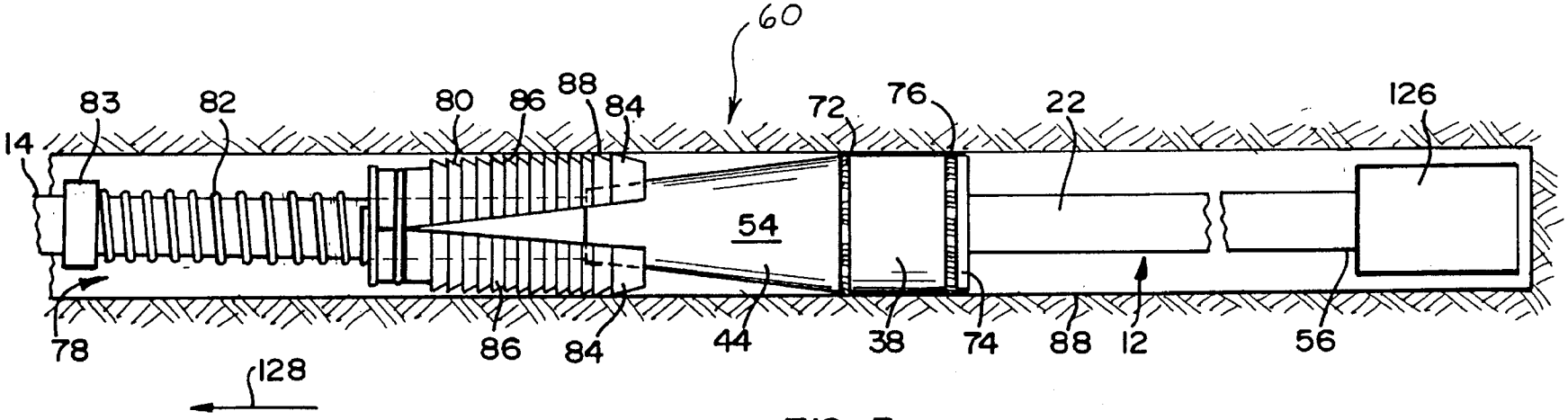
FIG. 3 shows a side view of the yielding anchor assembly of FIG. 2, in use.

The third nut 44 has a frusto-conical surface 54 defined thereon which, in use, is received within a mechanical shell 80 (FIG. 3) arranged at a head of a borehole 78 (FIG. 3).

The end 56 (FIG. 3) of the cable 14 has a stop 126 swaged thereon. Hence, once the portion 22 has passed through the passage 26, the stop 126 abuts against the second element 40 and further tension imparted to the cable 14 will cause the cable 14 to snap.

In use, to install the yielding anchor assembly 10, the jaw assembly 24 is placed within the first nut 38 to abut the tapered seat 42. The third nut 44 is screwed onto the first nut 38 and the position of the third nut 44 relative to the first nut 38 is adjusted according to the tension required. The second nut 40 is slipped over the end 56 and screwed into the first nut 38 to urge the jaws 30 into gripping relationship with the cable 14. Once assembled, the nuts 38, 40, 44 are tack-welded together to prevent tampering with the assembly 10. The end 56 of the cable 14 is fixed within the borehole 78 by the mechanical shell 80 so that the other end (not shown) of the cable 14 extends beyond the entrance of the borehole 78 with the bearing surface 54 of the third nut 44 being supported in the mechanical shell 80. Pre-tensioning of the cable 14 is effected in a jig prior to installation in the borehole 78. In this example, the cable 14 is pre-tensioned up to between approximately 18 and 22 tons, the cable 14 having a breaking strength in the region of 30 to 40 tons, optimally about 35 tons.

Figure 2:
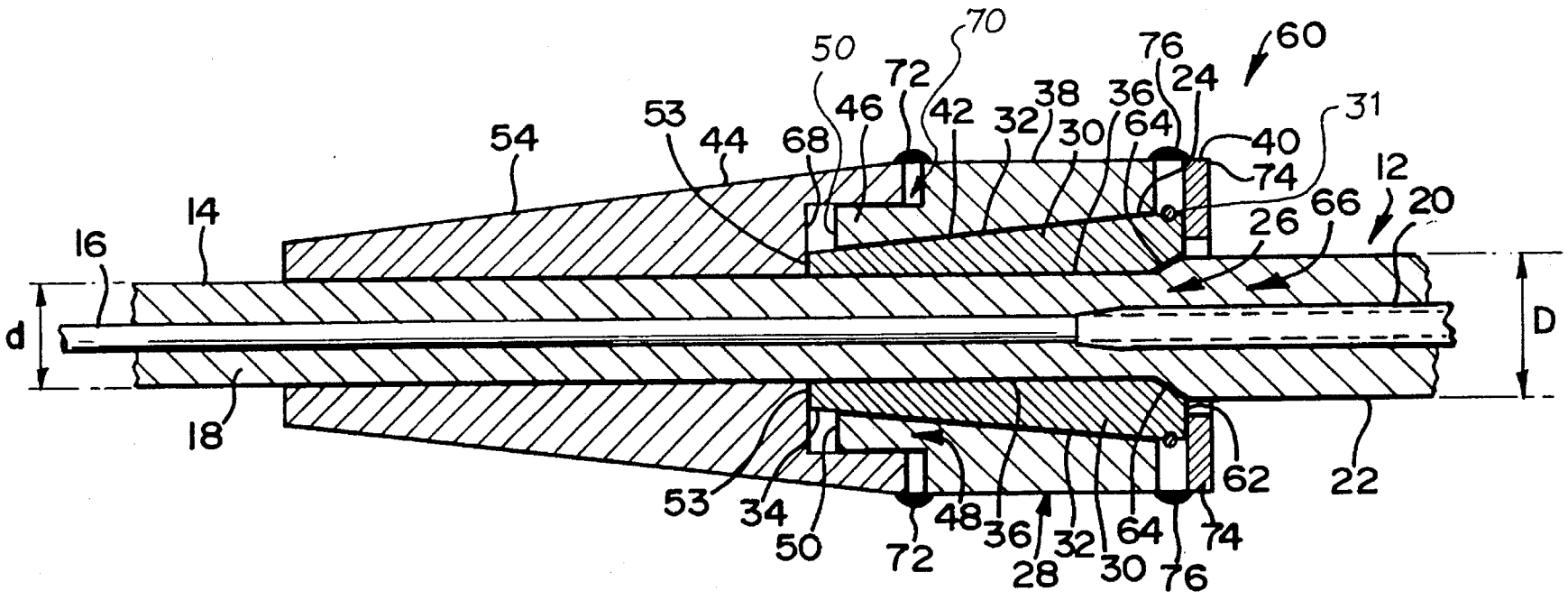
FIG. 2 shows a sectional side view of part of a yielding anchor assembly, in accordance with a second embodiment of the third aspect of the invention.

In FIG. 2, reference numeral 60 generally indicates part of a yielding anchor assembly in accordance with a second embodiment of the third aspect of the invention. With reference to FIG. 1, like reference numerals refer to like parts, unless otherwise specified.

With the assembly 60, each jaw 30 has a chamfer 64 defined at an inner surface of that end bearing against the portion 22 of the cable 14. Hence, the jaw assembly 24 defines a chamfered mouth 66. This facilitates movement of the enlarged portion 22 into the passage 26 and serves to inhibit longitudinal shearing of the cable 14 by the jaws 30.

Further, with the assembly 60, the elements 38, 44 are slidably, rather than threadedly, adjustable relative to each other. Hence, the projection 46 and the socket 48 are not threaded, the projection 46 being slidably received in the socket 48. A face 68 within the socket 48 defines the bearing surface 53. The first element 38 is dimensioned to permit the smaller end 34 of the jaw assembly 24 to project beyond the smaller end 50 of the tapered seat 42 to bear against the bearing surface 53.

It is to be understood that the clamping means 28 is mounted on the cable 14 off-site. Once the desired gripping force has been determined, the elements 38, 44 are located on the cable so that the gap 70 is the required size. The elements 38, 44 are then fixed relative to each other via suitable tack welds 72. The jaw assembly 24 is urged into abutment with the tapered seat 42 until the smaller end 34 bears against the surface 53. In this example, the jaw assembly 24 is hydraulically pre-seated using a force of approximately 12 tons. The second element 40 is in the form of a washer 74 which is fixed to the first element 38 via tack welds 76 and serves to retain the jaw assembly 24 in position.

The first element 38 is of a nickel-steel alloy with the seat 42 being case-hardened. The third element 44 is of mild steel.

In FIG. 3, there is shown the assembly 60 in the borehole 78. The frusto-conical surface 54 of the third element 44 is received partly within the mechanical shell 80 which is a conventional shell 80. The mechanical shell 80 is connected to a spring 82 which, in turn, is fastened to the cable 14 via a collar 83. The spring 82 serves to retain the shell 80 in an anchoring configuration in the borehole 78.

The shell 80 comprises four rock engaging elements 84. Each element 84 has a ribbed outer surface 86 defined thereon. Further, each element 84 has a tapered inner surface (not shown) defined thereon so that, when the shell 80 is assembled, the shell 80 defines an inner surface complementary to the surface 54. It will thus be appreciated that, as the tension in the cable 14 increases and the third element 44 moves in the direction of an arrow 128, the surface 54 bears against said inner surface of the shell 80 so that the elements 84 are urged into gripping engagement with a wall 88 defining the borehole 78.

Figure 8:
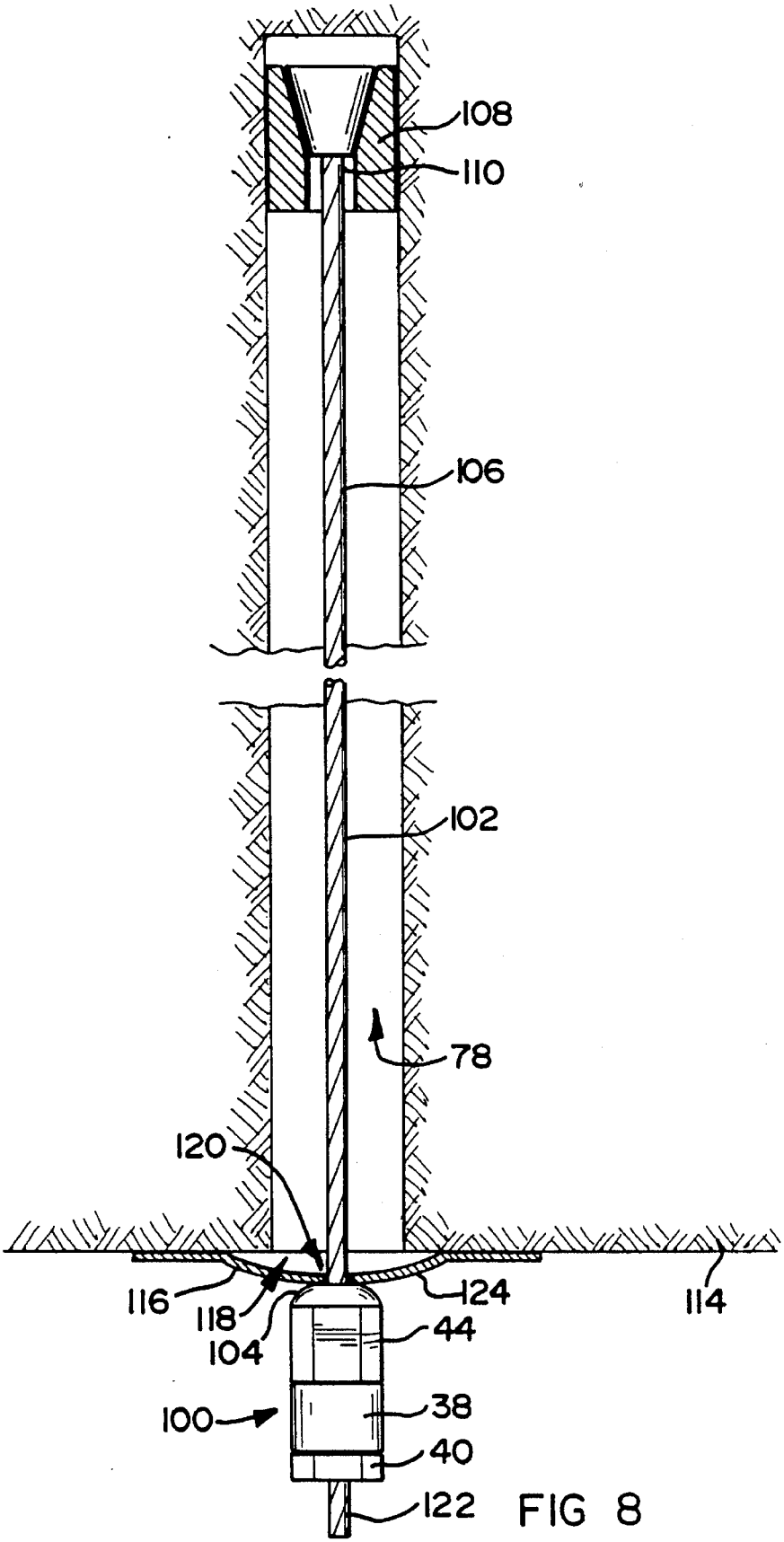
FIG. 8 shows a part-sectional side view of a rock anchor, in use, which includes the tensioning device of FIG. 6.

Those skilled in the art will appreciate that, instead of mounting the jaw assembly 24 and its associated clamping means 28 at the end of the cable 14, at the head of the borehole, the jaw assembly 24 and the clamping means 28 could be arranged on a part of the cable 14 extending beyond the entrance to the borehole 78. Then, the portion 22 of the cable 14 is arranged below and outwardly of the jaw assembly 24 and the third element 44 is shaped to bear against a suitable bearing surface, for example as defined by a dome washer (for example, as shown in FIG. 8 of the drawings), arranged about the cable 14 at the entrance to the borehole 78.

Figure 4:
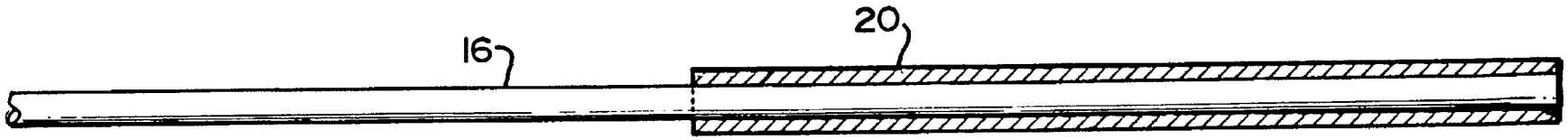
FIG. 4 shows a sectional side view of part of a rock anchor of a first aspect of the invention prior to deformation.
Figure 5:
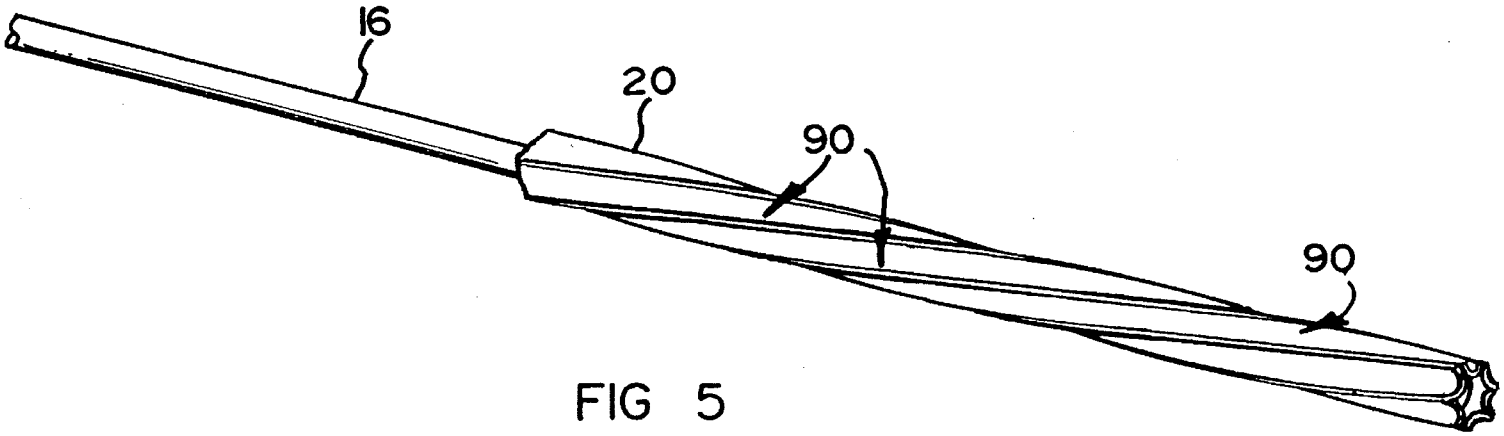
FIG. 5 shows a three dimensional view of said part of the rock anchor after deformation.

It is to be appreciated that, in use, it is desirable that a gradual yielding of the rock anchor 12 occurs. As can be seen in FIGS. 1 and 2, it is necessary that, in order for the portion 22 to pass through the passage 26, the dimension D be reduced to the dimension d. This occurs through a radial deformation of the portion 22, which, in use, occurs through deformation of the sleeve 20. In FIG. 4, the sleeve 20, prior to deformation, is shown and in FIG. 5, the sleeve 20, once it has been deformed, is shown. It can be seen from FIG. 5, that when the cable 14 is radially deformed so that its diameter changes from D to d, the sleeve 20 is, in turn, deformed to accommodate the outer strands 18 of the cable 14. Hence, a plurality of helically oriented recesses 90 are formed in the sleeve 20.

Since the sleeve 20 is malleable, such deformation will take place gradually, and this will result in a gradual yielding of the rock assembly 10. By positioning the third element 44 relative to the first element 38, as described above, this gradual yielding can, to an extent, be controlled by a user. In particular, it is possible, by adjusting the position of the third element 44 relative to the first element 38, to determine within the yielding limits of the cable 14, the tension at which yielding will occur.

Where the jaw assembly 24 and its associated clamping means 28 are arranged on the part of the cable 14 extending beyond the entrance to the borehole 78, a user can determine, by making suitable measurements, the amount of yielding or movement, occurring in the wall or roof. Hence, a user can judge whether or not the working conditions in that particular area are safe.

Figure 6:
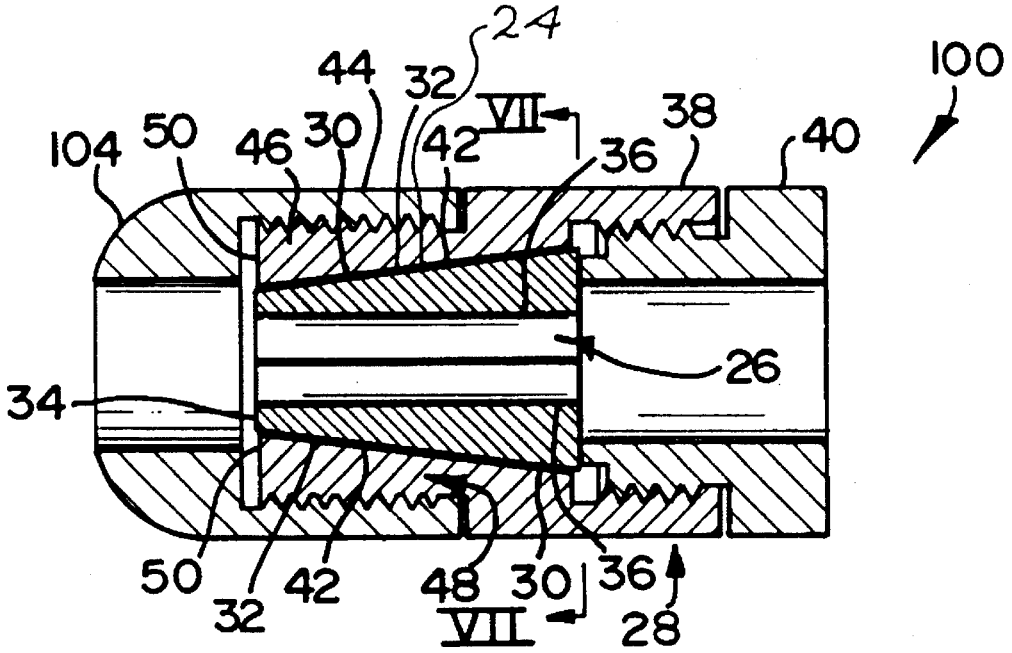
FIG. 6 shows a sectional side view of a tensioning device, in accordance with a second aspect of the invention.
Figure 7:
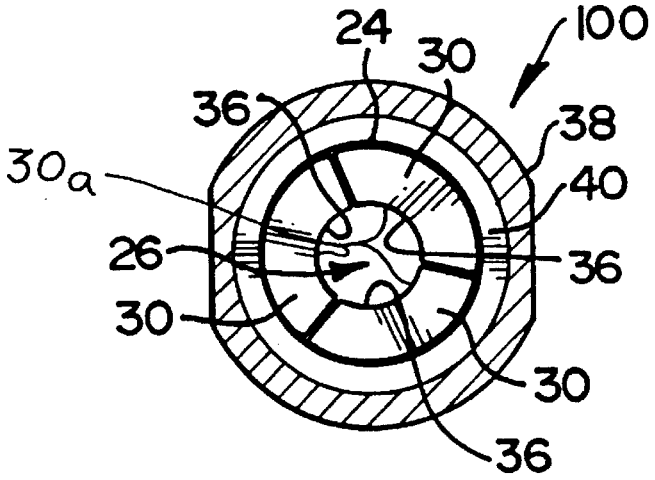
FIG. 7 shows a sectional front view of the tensioning device of FIG. 6 taken through VII—VII in FIG. 6.

In FIGS. 6 to 8, reference numeral 100 generally indicates a tensioning device, in accordance with a second aspect of the invention, for use with a roof anchor 102 (FIG. 8). With reference to FIGS. 1 to 5, like numerals refer to like parts unless otherwise specified.

As with the assemblies 10, 60 the tensioning device 100 has first, second and third elements 38, 40, 44.

Instead of having a frusto-conical bearing surface defined on the third element 44, the third element 44 has a convex bearing surface 104 defined on the third element 44.

Referring now to FIG. 8, there is shown the roof anchor 102 which includes the tensioning device 100. The roof anchor 102 includes a flexible roof bolt in the form of a length of standard multi-strand cable 106. The cable 106 has a mechanical shell arrangement 108 arranged at a first end 110 thereof.

The roof anchor 102 is receivable within the borehole 78 drilled into a roof 114 of a mine. The roof anchor 102 includes a dome washer 116 locatable over an entrance 118 of the borehole 78. The dome washer 116 has an opening 120 defined therein through which the cable 106 passes, in use. A portion 122 of the cable 106 extends beyond the dome washer 116. The tensioning device 100 is fastenable to the portion 122. The convex bearing surface 104 defined on the nut 44 bears against a convex surface 124 defined by the dome washer 116, in use.

Further, in use, the cable 106 with the mechanical shell arrangement 108 arranged on the end 110 thereof is located within the borehole 78. The dome washer 116 is placed in position with the portion 122 protruding from the opening 120. The portion 122 is then threaded through the tensioning device 100, the tensioning device 100 having been loosened to permit this. The tensioning device 100 is placed in such a position that the bearing surfaces 104, 124 abut against each other. Then, the nut 40 is tightened to cause the jaw assembly 24 to grip the cable 106. Once the jaw assembly 24 has exerted a suitable gripping force on the cable 106, the nut 44 is turned so that the bearing surface 104 bears against the surface 124 and the nut 38 is urged away from the nut 44 thus tensioning the cable 106.

As with the assemblies 10, 60 the inner surface 36 of each jaw 30 is smooth to facilitate some slippage of the device 100 relative to the cable 106 once the jaws 30 are tightened. Furthermore, the nut 40 is calibrated with respect to the nut 38 so that a desired gripping force is exerted on the cable 106, in use. The calibration is such that at the desired force it indicates the load which will have to be exerted on the cable 106 to cause the device 100 to slip relative to the cable 106. Hence, instead of the cable 106 failing when a sudden force is exerted on the cable 106, the device 100 will slip relative to the cable 106 when said load is applied. This will, in use, inhibit sudden collapsing of the mine roof 114 and thereby improve the safety within the mine.

As a result of the use of the cable 106, manipulation of the roof anchor 102 into the borehole 78 where the mine roof 114 is relatively low is facilitated. Presently, rigid roof bolts often have to be provided in lengths which have to be coupled together as they are fed, one by one, into the borehole. Hence, it will be appreciated that this invention results in a faster and more cost-effective anchoring process in comparison with a roof anchor which includes a rigid roof bolt.

As indicated above, the tensioning device 100 can be used with the cable 14. Then, the enlarged part 22 of the cable 14 is arranged outwardly of, and below, the tensioning device 100. As the roof 114 moves, the cable 14 is drawn into the borehole 78 via the radial deformation of the part 22 and relative movement between the cable 14 and the tensioning device 100. It will be appreciated that this will readily serve as an indication of the amount of movement of the roof 114.

Instead of having smooth inner surfaces 36, the inner surface 36 of each jaw 30 can be roughened, as indicated by 30*a* in FIG. 7, to facilitate gripping of the cable 14.

I claim:

1. A rock anchor which includes a multi-strand cable; and a sleeve of a yielding material received over a part of at least one strand of the cable with other strands surrounding the sleeve radially to enlarge a transverse dimension of a portion of the cable, the transverse dimension being reducible on the application of a suitable force applied to the sleeve.

2. The rock anchor as claimed in claim 1, in which the sleeve is of a suitably malleable metal so that, on the application of a predetermined radially and inwardly directed force exerted on the strands surrounding the sleeve, the metal is deformed to permit a reduction in the transverse dimension of the portion of the cable.

3. The rock anchor as claimed in claim 1, which includes a stop arranged at one end of the cable, the stop having a transverse dimension which is greater than that of said enlarged transverse dimension of the cable.

4. A tensioning device for use with a rock anchor, the device including a jaw assembly having a plurality of discrete jaws which define a passage through which a cable of the rock anchor can pass, the jaws each having a tapered outer surface;

a clamping means for urging the jaws into gripping relationship with the cable, the clamping means defining a tapered seat which is complementary to the tapered outer surfaces of the jaws;

a tensioning member carried on the clamping means for effecting tensioning of the cable; and an adjustment means, arranged on the clamping means, for adjusting the position of the jaw assembly relative to the tapered seat thereby to adjust a transverse dimension of the passage.

5. The device as claimed in claim 4, in which the clamping means comprises a first element which defines the tapered seat and a second element which is arranged on the first element to retain the jaw assembly in position once the jaw assembly has been urged into abutment with the seat so that the jaws are urged into gripping engagement with the cable, in use.

6. The device as claimed in claim 5, in which the adjustment means includes a third element adjustably arranged on, and displaceable relative to, the first element of the clamping means, the third element defining a bearing surface which is positioned such that, on displacement of the third element towards the first element, the surface bears against the jaw assembly and displaces the jaw assembly towards a larger end of the tapered seat.

7. The device as claimed in claim 5, in which each jaw has a smooth inner surface defined thereon.

8. The device as claimed in claim 7, in which the second element is calibrated so that a user can adjust the gripping force of the jaws.

9. The device as claimed in claim 5, in which each jaw has an inner surface which is roughened to facilitate non-slip gripping of the roof bolt.

10. A yielding anchor assembly which includes an elongate element;

an enlarging means carried on at least a portion of the elongate element for enlarging a transverse dimension of said portion of the elongate element, said transverse dimension being reducible on the application of a suitable force applied to the enlarging means; and a tensioning device for tensioning the elongate element, the tensioning device defining a passage through which the elongate element slips when said suitable tension is exceeded, the passage being dimensioned so that when the tension is exceeded, the suitable force is applied to the enlarging means to reduce the transverse dimension and to permit the portion to be drawn through the passage.

* * * * *